US005267750A

United States Patent [19]

Thompson

[11] Patent Number: 5,267,750

[45] Date of Patent: Dec. 7, 1993

[54] MOBILE CART

[76] Inventor: Michael R. Thompson, 1622 NW. Pine, Ankeny, Iowa 50021

[21] Appl. No.: 910,497

[22] Filed: Jul. 8, 1992

[51] Int. Cl.[5] ..... B62B 1/12

[52] U.S. Cl. ..... 280/646; 280/DIG. 6

[58] Field of Search ..... 280/DIG. 6, 646, 652, 280/40

[56] References Cited

U.S. PATENT DOCUMENTS

| | | | |
|---|---|---|---|
| 2,517,065 | 8/1950 | Watson | 280/DIG. 6 |
| 2,761,691 | 9/1956 | George | 280/DIG. 6 |
| 2,782,048 | 2/1957 | Williams et al. | 280/DIG. 6 |
| 2,784,005 | 3/1957 | Abgarian | 280/DIG. 6 |
| 2,885,215 | 5/1959 | Williamson | 280/DIG. 6 |
| 3,150,881 | 9/1964 | Van Skyock | 280/DIG. 6 |
| 3,985,372 | 10/1976 | Olsson | 280/DIG. 6 |
| 4,053,169 | 10/1977 | Taylor | 280/DIG. 6 |
| 4,142,736 | 3/1979 | Ackerfeldt et al. | 280/DIG. 6 |
| 4,382,612 | 5/1983 | Larkin | 280/646 |
| 4,522,299 | 6/1985 | Clark et al. | 280/646 |
| 4,822,071 | 4/1989 | Widegren | 280/646 |
| 4,911,465 | 3/1990 | Hauer | 280/646 |
| 5,074,576 | 12/1991 | Finlay | 280/DIG. 6 |

*Primary Examiner*—David M. Mitchell
*Attorney, Agent, or Firm*—G. Brian Pingel

[57] ABSTRACT

A mobile cart including a wheel mechanism and a handle mechanism attachable to a specially designed container for golf clubs and accessories, or attachable to a specially designed golf club container receiving bracket where the wheel mechanism and handle extends to provide for semi-upright support and wheeled locomotion of the cart. The wheel mechanism provides a means for collapsing one wheel from its operating position toward the top or open end of the container and the other wheel toward the bottom or closed end of the container and where each wheel when collapsed is adjacent and approximately parallel to an elongated wall of the bag. The handle collapses from its operating position to a collapsed position internal to or adjacent to the container. The club container includes upper and lower elements attachable to the ends of elongated support tubes which are covered by a fabric to form a bag.

18 Claims, 14 Drawing Sheets

도면 4

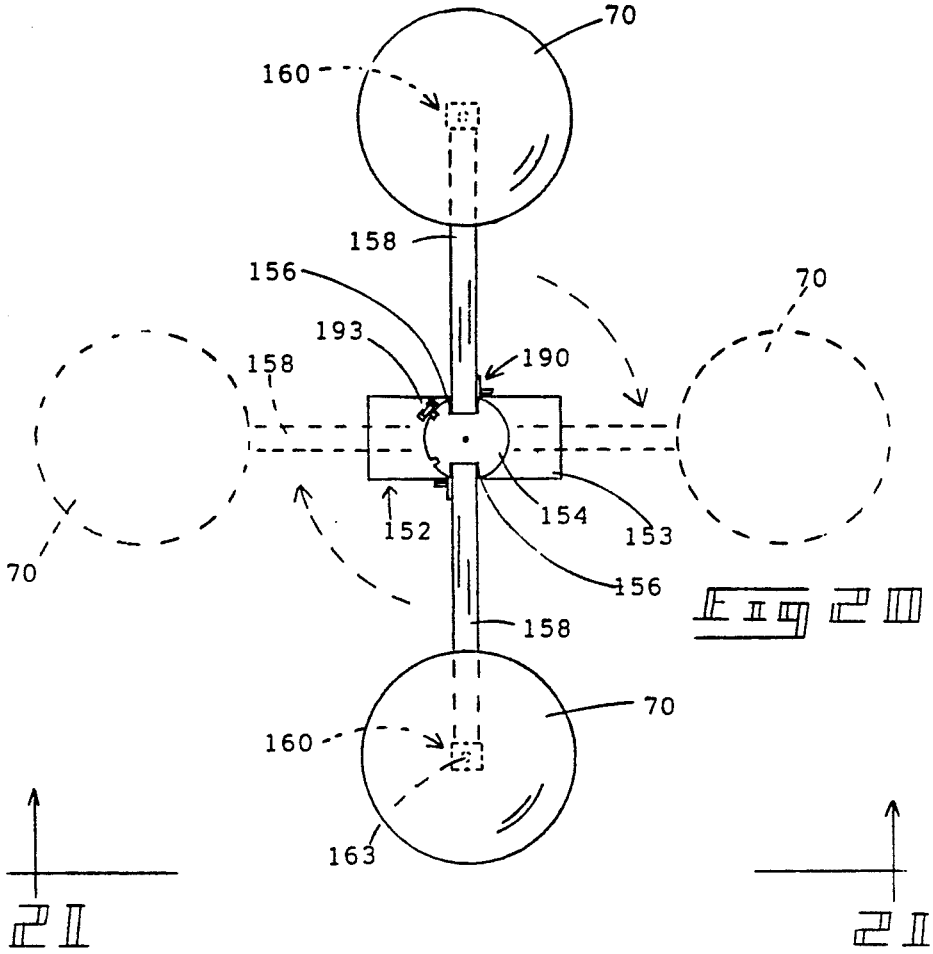
70
160
158
156
193
190
158
70
152
154
153
156
70
158
70
160
163
FIG 20
FIG 21
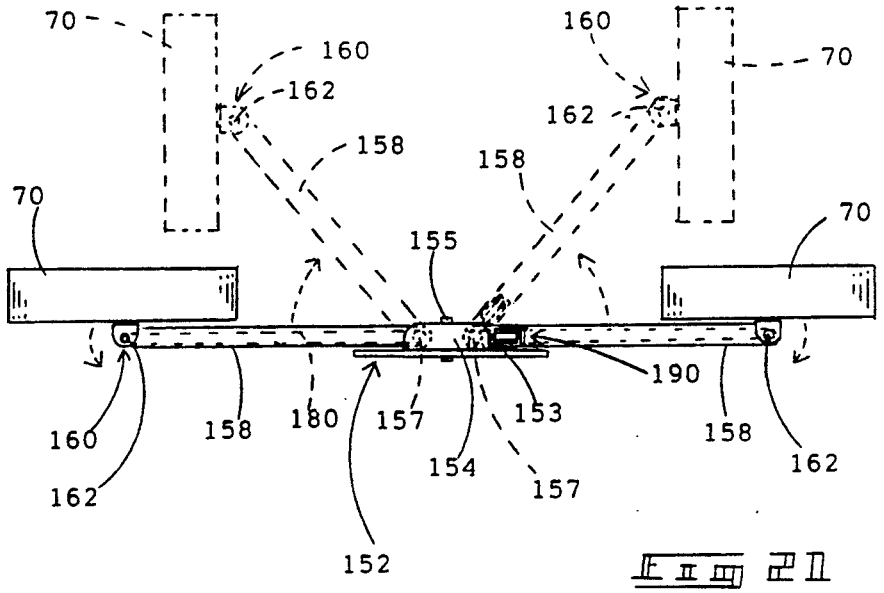
70
160
162
158
160
70
162
158
70
155
70
190
160
158
180
157
153
158
162
162
154
157
152
FIG 21

MOBILE CART

TECHNICAL FIELD

This invention generally relates to mobile carts, and more particularly to carts having a foldable wheel mechanism movable between an extended ground engaging transport position and a retracted storage position.

BACKGROUND ART

Numerous mobile carts with folding wheel mechanisms are available. Wheel mechanisms in the prior art, however, have traditionally collapsed from their operating positions downward toward the bottom closed end of the golf club container with the wheels remaining parallel to their extended operating position. There are many disadvantages to this type of mechanism: the container and cart when collapsed become bottom heavy and make lifting and carrying cumbersome; the nature of this type of mechanism when collapsed creates a bulky unit which makes it difficult to store, place in a trunk, put on a motorized cart, take on an airplane, etc.

Those concerned with these and other problems recognize the need for an improved foldable mobile cart.

DISCLOSURE OF THE INVENTION

The present invention is based upon a unique new concept for a foldable wheel mechanism which can be designed as a built-in feature of a unique golf club container and/or as a feature of a separate golf club container receiving bracket which is designed to receive a conventional golf bag. The invention also includes a handle mechanism which can be designed as a built-in feature of a combined golf club container and/or as a feature of a separate golf club container receiving bracket. The invention further includes a uniquely designed golf club container designed to be coupled with the specially designed wheel and handle mechanisms described above. Furthermore, the invention includes the bag supports and structure of a golf club container receiving bracket which is designed to be coupled with the wheel and handle mechanisms described above.

The present invention generally includes a wheel mechanism having a rigid base member which can be designed to be connected to either a specially designed golf club container or container receiving bracket and to which two movable legs are attached. The base member, furthermore, provides the means of moving the legs from their extended positions to their collapsed positions. Attached to the opposite end of each leg is a pivotable wheel axle assembly which supports the axle to which the wheel is attached. The pivotable wheel device allows the wheel to be moved from its extended operating position to its collapsed transport or storage position. The invention also includes a handle mechanism which includes a rigid base member that can be designed to be connected to a specially designed golf club container or container receiving bracket. The base member supports a tubular arm and provides the means of moving the arm from an extended operational position to a collapsed position adjacent to the wall of the golf club container or container receiving bracket. At the end of the arm is a grip for manual manipulation of the cart. The invention further includes a uniquely designed golf club container which is designed to achieve an aesthetically appealing compact fit with the aforementioned wheel and handle mechanisms which are designed to be coupled with the container. The container includes a rigid open upper element designed for receiving the clubs and a rigid closed bottom element designed to support the end of the clubs. Extending between the elements are rigid support tubes which are adjacent to the exterior walls of the golf club container. The container is covered by a fabric which includes pockets for storage of golf accessories. The upper and lower elements of the container are uniquely designed to define the shape of the bag walls which accomplishes an optimal fit and functional shape for the combined units.

The invention also includes a golf club container receiving bracket to which the wheel and handle mechanisms can be attached. The bracket includes a rigid upper element and lower element which provides support for a separate bag and includes straps for connecting a bag to those elements. Separating the elements is one or two elongated support tubes to which the wheel and handle mechanisms are attached.

The present invention overcomes the disadvantages inherent in prior art devices by collapsing the wheeled mechanism in a unique novel fashion. One leg and corresponding wheel is collapsed from its operating position toward the top or open end of the golf club container while the opposite leg and corresponding wheel is collapsed from its operating position toward the bottom or closed end of the golf club container. In the collapsed position both legs and wheels are adjacent to an elongated wall of the bag. Furthermore, instead of the wheels being parallel to their operating position, they are now perpendicular to that position which allows both wheels to collapse flat against opposite ends of the same elongated wall of the bag. The advantages of this type of mechanism are a compact, balanced, aesthetically appealing means of collapsing the wheeled mechanism which makes the combined product easy to lift, store, place on motorized carts, and take on planes, etc.

A principle objective of the present invention is to create a wheeled mechanism which when attached to a specially designed golf club container or golf club container receiving bracket provides the means for wheeled locomotion of the container or cart and semi-upright support of the container or cart when the mechanism is in its extended position and which from this operational position provides the means to collapse the mechanism in a unique novel fashion.

The second objective of the invention is to provide a handle mechanism which can be connected to the structure of the golf club container or to the structure of the container receiving bracket and which provides a means of supporting the arm and handle in an extended position for pulling the cart and also provides a means for collapsing the arm and handle to a collapsed position either internal to or adjacent to the side of the bag.

A third objective of the invention is to create a uniquely designed bag that is designed to be coupled with the aforementioned wheel and handle mechanisms to form a compact, lightweight, aesthetically appealing and efficiently combined product. The bag will have an open upper element and closed bottom element which are uniquely designed to form the shape of the container. Separating the elements will be multiple elongated support tubes which help form the exterior walls of the container. The skeletal structure will be covered by a fabric which will include multiple pockets for storage of golf accessories.

A fourth objective is to provide a container receiving bracket having rigid upper and lower elements designed to support a separate bag. The elements include straps for fastening the bag to the bracket. The elements are connected to opposite ends of an elongated tube or tubes to which the wheel and handle mechanisms are connected.

A further objective of the invention is to create a consolidated golf bag and cart that is novel in design and as a result more compact, lightweight, balanced, easier handling and aesthetically more appealing than traditional products.

Yet another objective of the invention is to provide a color coordinated combined product.

A still further objective is to provide a device that is simple and economical to manufacture.

Other objects of my invention which have not been aforementioned will appear in the body of the remainder of this application. In carrying out the objects of the invention, however, it is to be remembered that features are susceptible to change in design and structural arrangement with only one preferred and practical embodiment being illustrated in the accompanying drawings as required.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 20 is a bottom plan view of an alternative embodiment of the wheel mechanism in the fully retracted position wherein the rotation of the leg base is illustrated in dashed lines;

FIG. 21 is a front elevational view of the alternative embodiment of the wheel mechanism shown in FIG. 20 with the leg base rotated to a extended position and wherein downward rotation of the legs is illustrated in dashed lines;

BEST MODE FOR CARRYING OUT THE INVENTION

Figure 1:
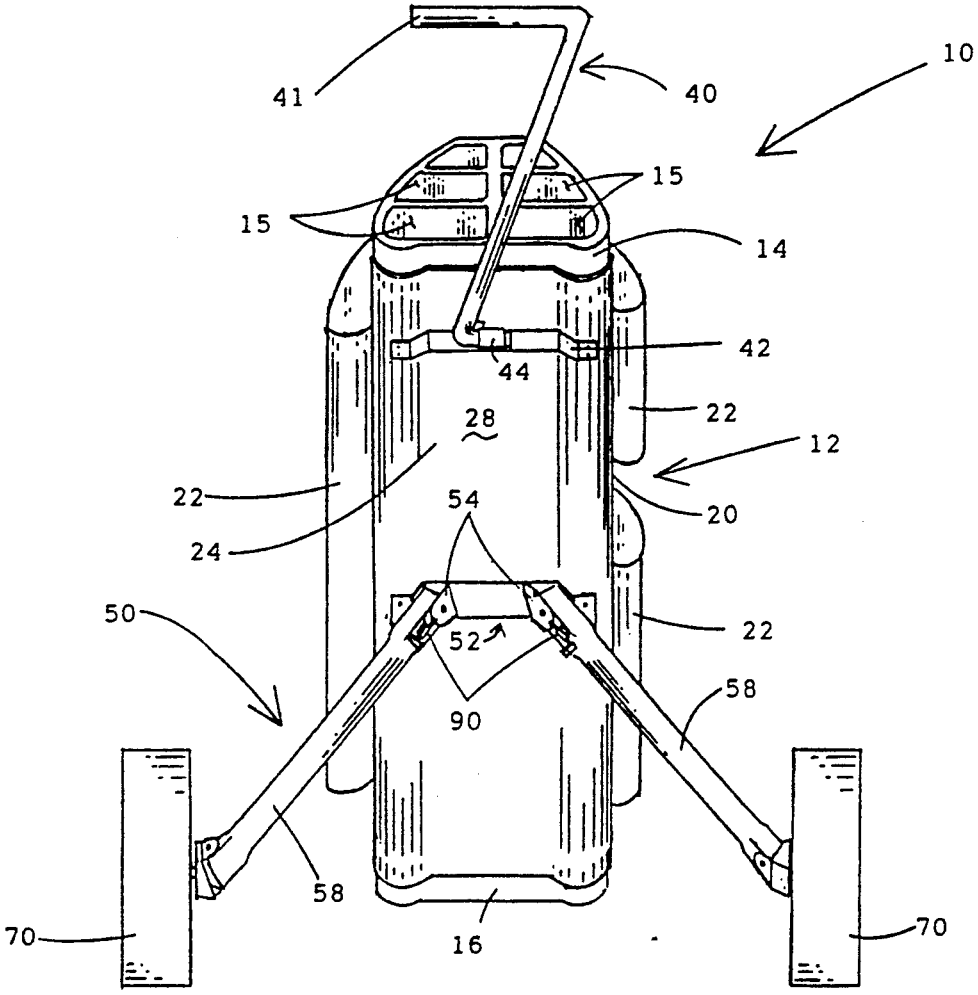
FIG. 1 is a front elevational view of one embodiment of the invention wherein the mobile cart includes a unique golf club container, and the foldable wheel mechanism and handle are attached by base members directly to the unique container.
Figure 2:
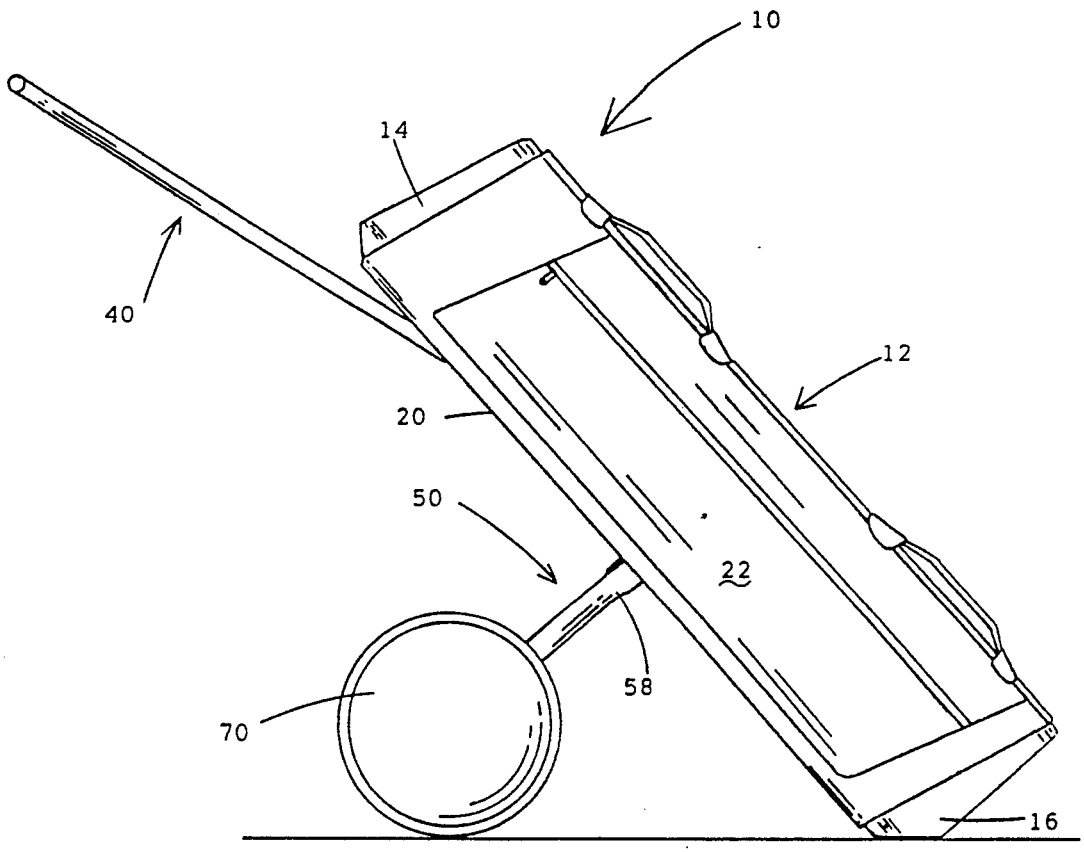
FIG. 2 is a side elevational view thereof shown with the bottom of the container resting on the ground.
Figure 3:
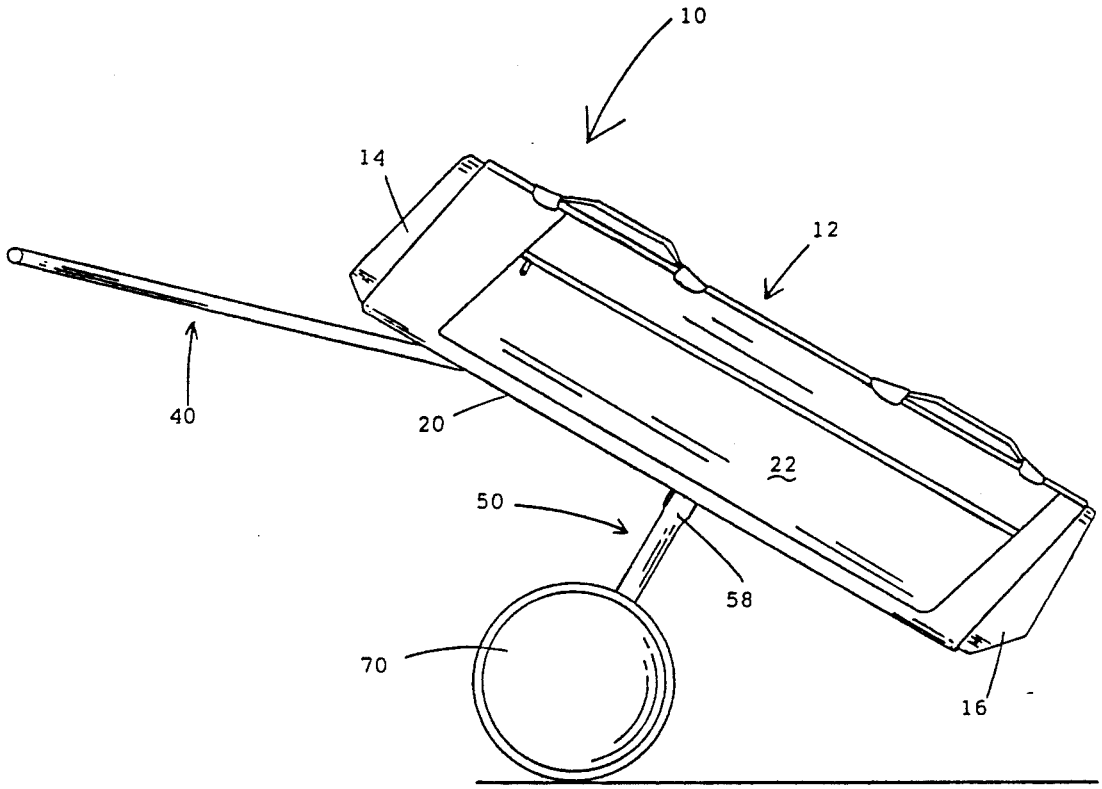
FIG. 3 is a side elevational view similar to FIG. 2 but showing the container bottom elevated above the ground and positioned to be moved from one location to another.
Figure 4:
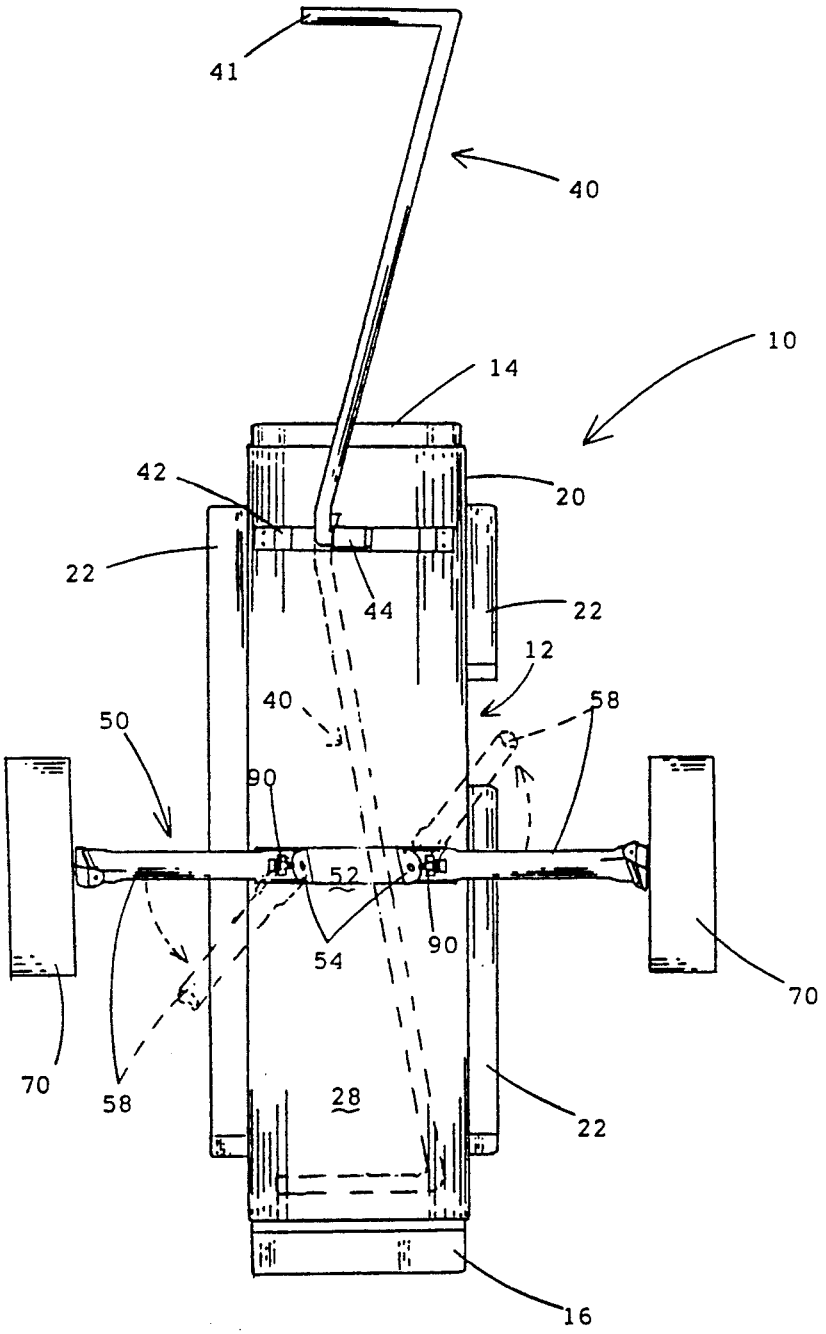
FIG. 4 is a plan view of the underside of the mobile cart wherein the folding of the legs and handle toward the storage position are illustrated in dashed lines.
Figure 5:
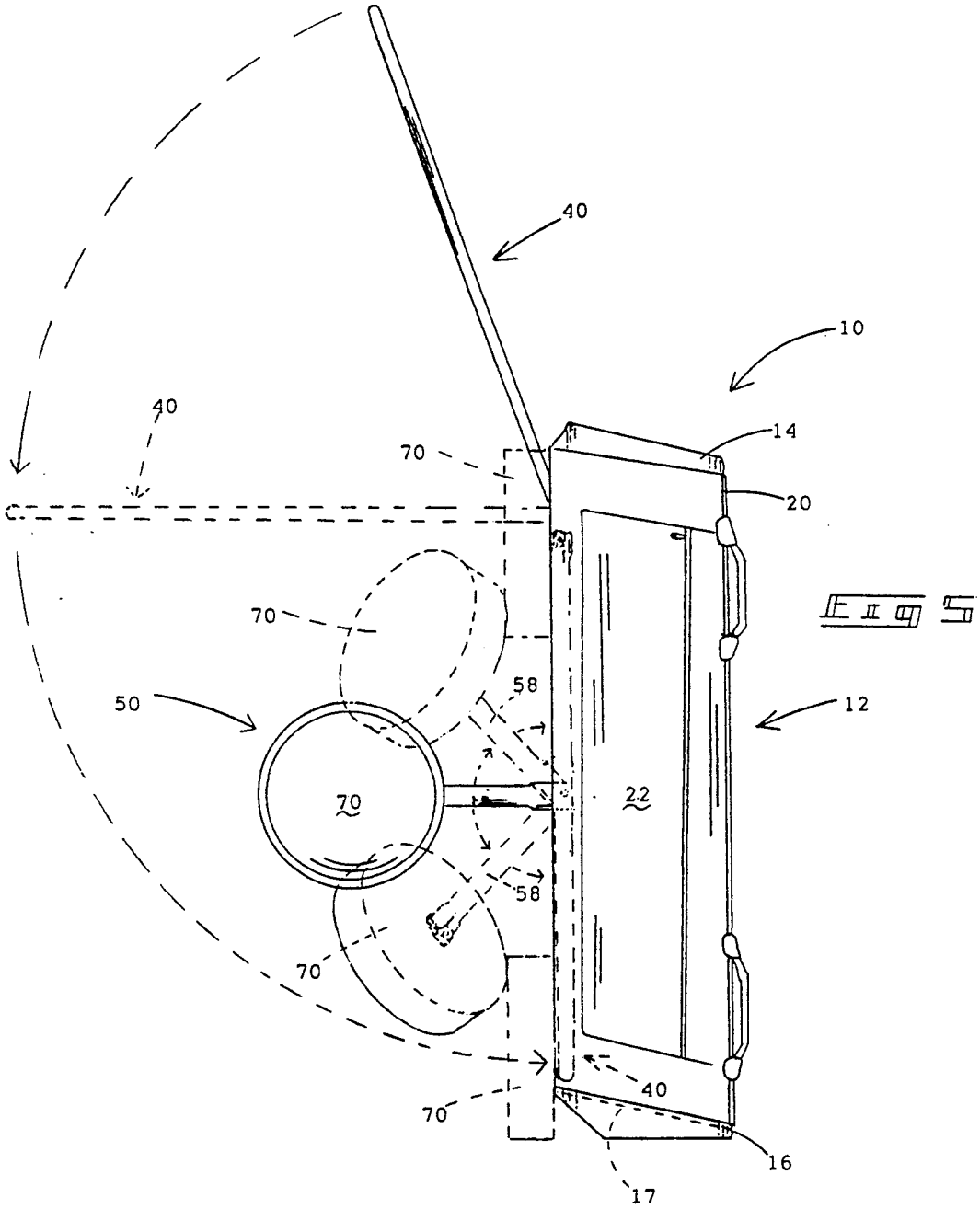
FIG. 5 is a side elevational view thereof wherein the folding of the legs and handle are illustrated in dashed lines in both an intermediate and full-folded position.

Referring now to the drawings, wherein like reference numerals designate identical or corresponding parts throughout the several views, FIG. 1 shows the mobile cart (10) of the present invention. The cart (10) includes a specially designed golf club container (12) which is connected to a foldable wheel mechanism (50) and handle (40). As best shown in FIGS. 1–7, the container (12) includes an open upper element (14) and closed bottom element (16). Connecting the elements (14 and 16) are multiple elongated support tubes (18) and (26). A fabric bag (20) is fitted over this structure which includes pockets (22) for storage of accessory items.

Figure 6:
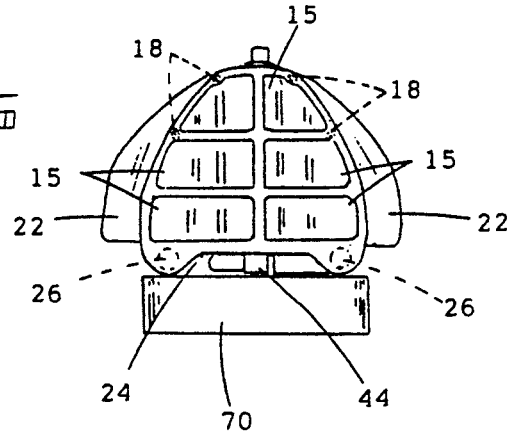
FIG. 6 is a plan view at the top of the golf club container showing the ground wheel in the fully retracted storage position.

The peripheral walls of the upper and lower elements (14 and 16) define the shape of the bag walls. A wall of each element (14 and 16) forms a forwardly directed concave cavity (24)(FIG. 6). Spaced out from each side of the cavity (24) an elongated tubing (26) extends between and connects the upper and lower elements (14 and 16). The concave shape of the cavity (24) extends the entire length of the elongated bag wall (28). The elongated cavity (24) acts to receive portions of the wheel mechanism (50) and handle (40) to allow them to collapse flat against the portion of the bag (20) covering the elongate tubing (26). This shape gives the appearance that the wheel mechanism (50) is collapsed flat against the elongated wall (28) of the bag (12).

The remaining peripheral walls of the two elements (14 and 16) form the shape of an arch. The upper element (14) is primarily open for receiving golf clubs. There are, however, several dividers which form six compartments (15) in the interior of the bag (12). The compartments (15) help separate and spread the clubs. There are also fabric inserts which extend these dividers to the bottom element (16) of the bag (12). Furthermore, the top element (14) is slanted from the concave wall (28) toward the opposite wall. This shaping gives open access to the clubs.

The bottom element (16) on the other hand has a closed surface to support the end of the clubs. The shape of the bottom, however, is unique. The exterior of the bottom surface of the element (16) is partially angled from the edge of the concave wall (28) to the medial portion of the bottom element (16). This angling helps raise the angle of the container (12) in its operational mode. The remaining exterior portion of the bottom element (16) is flat and perpendicular to the elongated tubing (26) between the top and bottom elements (14 and 16). Inside the bottom element (16) is a secondary bottom surface (17) which is sloped from the concave wall (28) to the opposite wall. The slope corresponds to the slanting of the top element (14).

Figure 8:
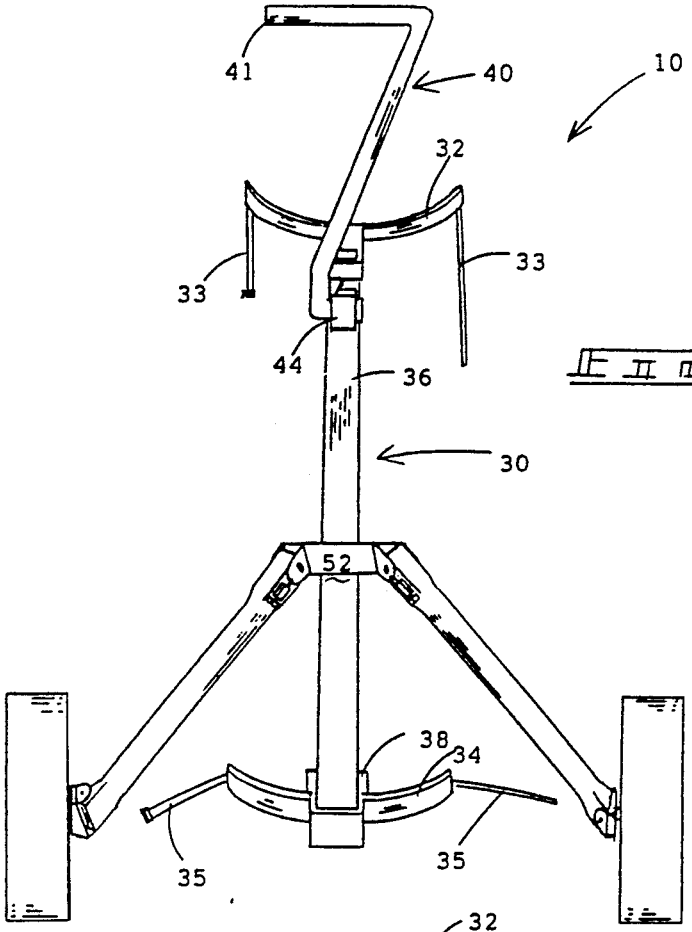
FIG. 8 is a front elevational view of another embodiment of the invention wherein the mobile cart includes a golf club container receiving bracket (container not shown) with the attached foldable wheel mechanism and handle.
Figure 9:
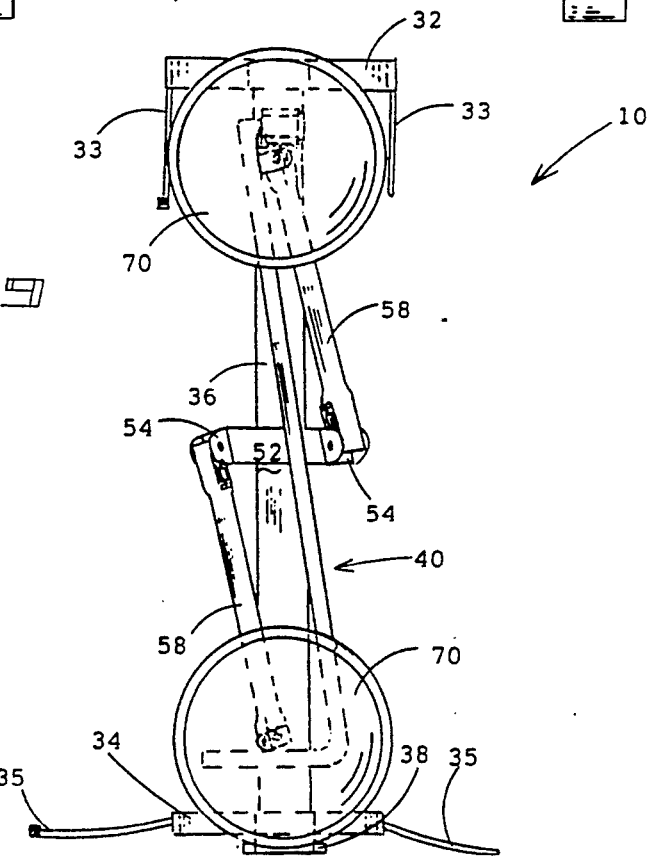
FIG. 9 is view similar to FIG. 7 showing this embodiment in the storage position.
Figure 10:
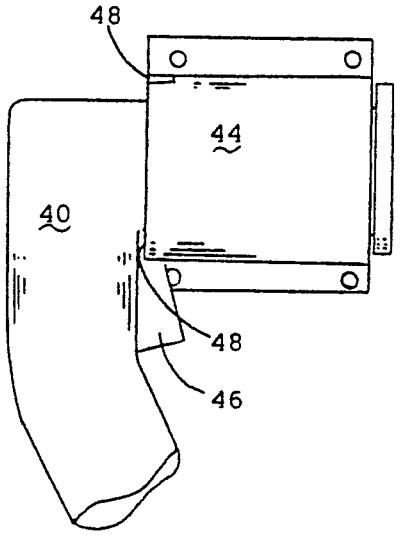
FIG. 10 is a greatly enlarged cutaway view showing the handle pivoted to and secured in the storage position.
Figure 11:
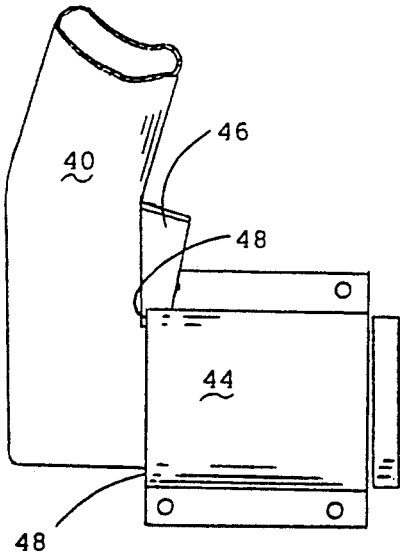
FIG. 11 is a view similar to FIG. 10 but showing the handle pivoted to and secured in the extended transport position.

As best shown in FIGS. 8 and 9, the invention also includes a golf club container receiving bracket (30) which is designed to be connected to the aforementioned wheel mechanism (50) and handle (40). The receiving bracket (30) is comprised of a top and bottom element (32 and 34) and an elongated tubing element (36) extending between and connecting the elements (32 and 34). The top element (32) is connected to the top of the elongated tube (36) and extends outwardly therefrom to form a quarter moon shaped part. At the ends of the top element (32) are straps (33) which are used to connect a conventional bag to the top element (32).

The bottom element (34) is connected to the opposite end of the elongated tubing (36). The bottom element (34) also branches out in a quarter moon shape and contains a bottom tongue (38) upon which the bottom of a conventional bag rests. The bottom element (34) also includes straps (35) for fastening a bag to the bottom element (34).

As most clearly shown in FIGS. 1, 4 and 8–11, the foldable handle mechanism (40) is attached to the golf club container (12) or receiving bracket (30), by a base member (42) or the support fitting (44). The purpose of the handle mechanism (40) is to provide the means for manual manipulation of the cart (10).

The preferred form of handle mechanism (40) includes a base member (42) connected to the elongated tubing (26) of the golf club container (12) to support a fitting (44) to which one end of the handle (40) is pivotally attached. The handle (40) is free to pivot from a position adjacent to the side (28) of the bag (12) to a position extending beyond the upper element (14) of the bag (12). The handle (40) is locked into position via a spring loaded pin (46) which locks into notches (48) in the fitting (44). The handle (40) is bent into a shape which fits with the collapsed wheel mechanism (50) and forms a grip (41) at the end for manual manipulation of the cart (10).

Another embodiment (not shown) of the handle mechanism (40) for the cart (10) is an internally collapsing mechanism. The mechanism is comprised of a base assembly designed to be connected to the elongated tubing (26) which is adjacent to the elongated wall (28) of the bag (12). The base assembly also forms a slot which is curved at or near the imaginary center line between the top and bottom elements (14 and 16) of the golf club container (12). A long tubular arm is inserted into this slot and can be extended or retracted into and out of the bag (12) through the slot. The top end of the tube carries a grip for manual manipulation. The mechanism would also be locked in the extended or retracted positions in a spring loaded latch.

The present invention is based on a unique, novel concept for a foldable wheel mechanism (50) which can be attached to a unique golf club container (12) or container receiving bracket (30) for carrying a traditional golf bag.

The foundation of the preferred wheel mechanism (50) is the base assembly (52). The base assembly (52) has two main purposes: to connect the wheel mechanism (50) to the golf club container (12) or receiving bracket (30) and to support the legs (58) of the wheel mechanism (50).

Figure 12:
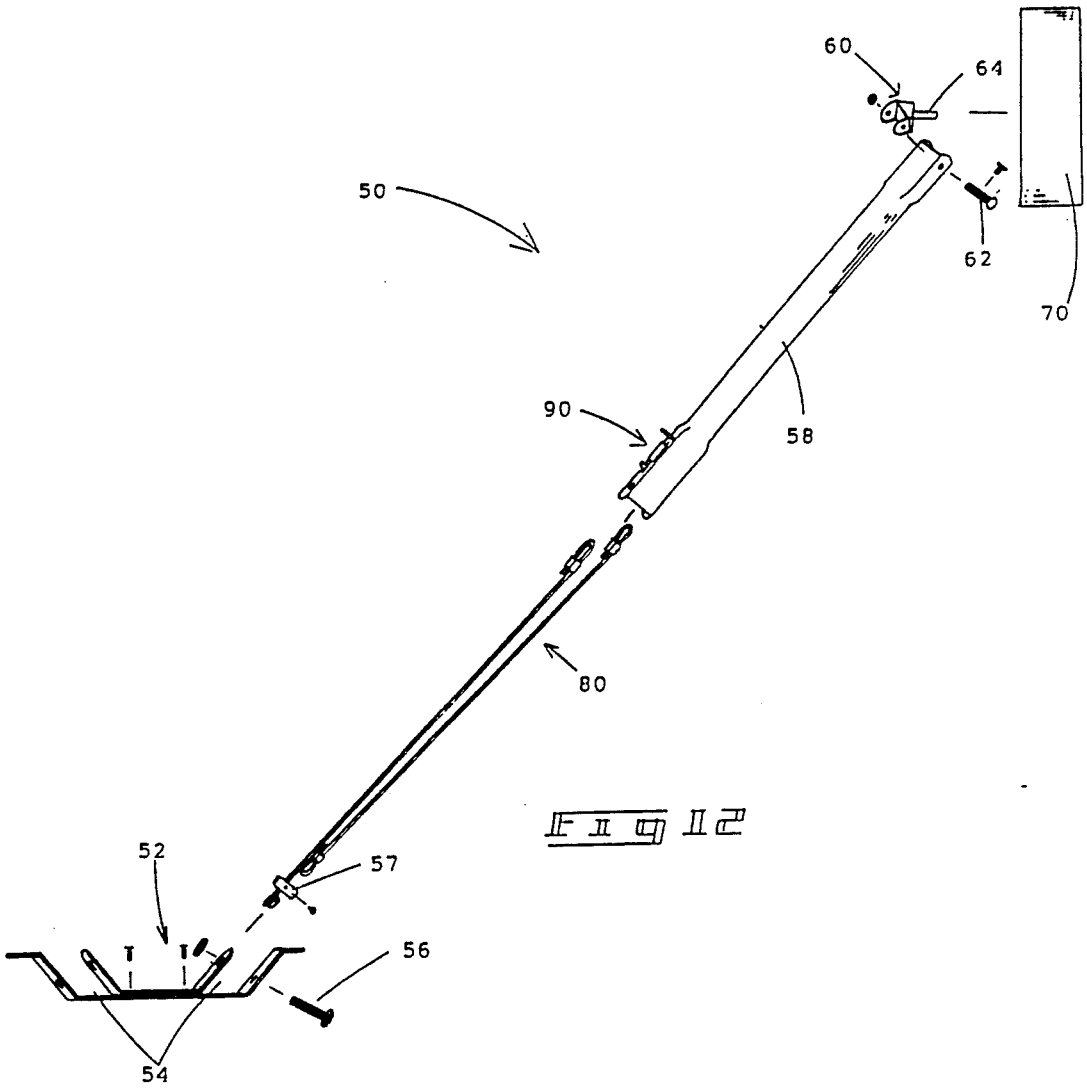
FIG. 12 is an exploded perspective view of the wheel mechanism showing one of the pair of ground wheels, the other wheel being similarly configured but disposed to fold in the opposite direction.
Figure 13:
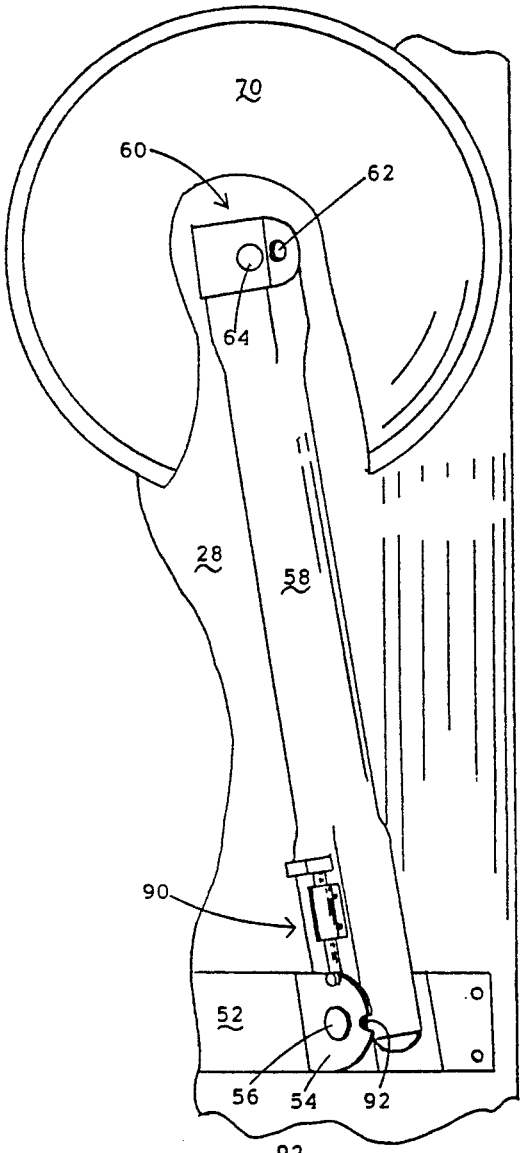
FIG. 13 is an enlarged partial cutaway view showing one wheel in the fully retracted storage position.
Figure 14:
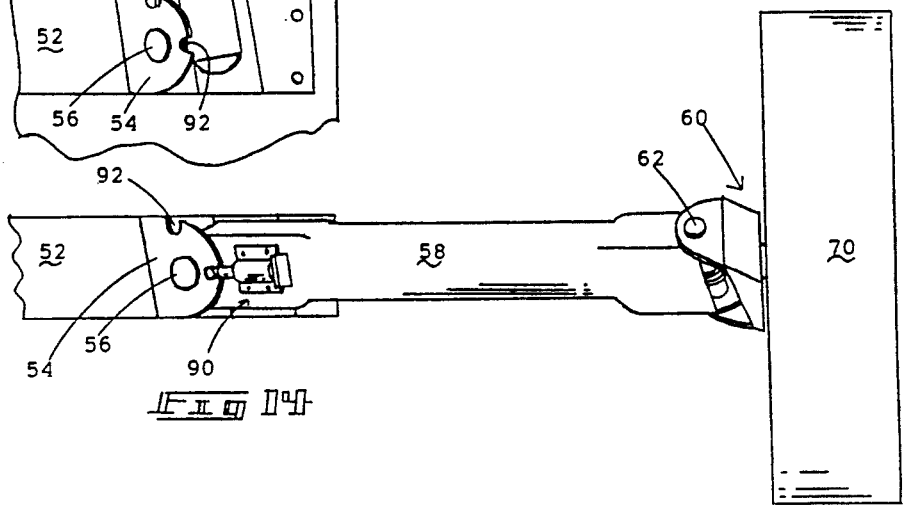
FIG. 14 is an enlarged partial view showing the wheel in the fully extended transport position.

The base assembly (52) can be designed in several different forms for connection with the golf club container (12) or golf club container receiving bracket (30). The design is primarily dependent on the structure to which it will be connected. For the purposes of this illustration, the base (52) will be described to connect to two elongated support tubes (26) of the specially designed golf club container (12), and with one elongated support tube (36) in the case of the receiving bracket (30). Examples of the two bases (52) are shown in FIGS. 1, 8 and 12.

Figure 7:
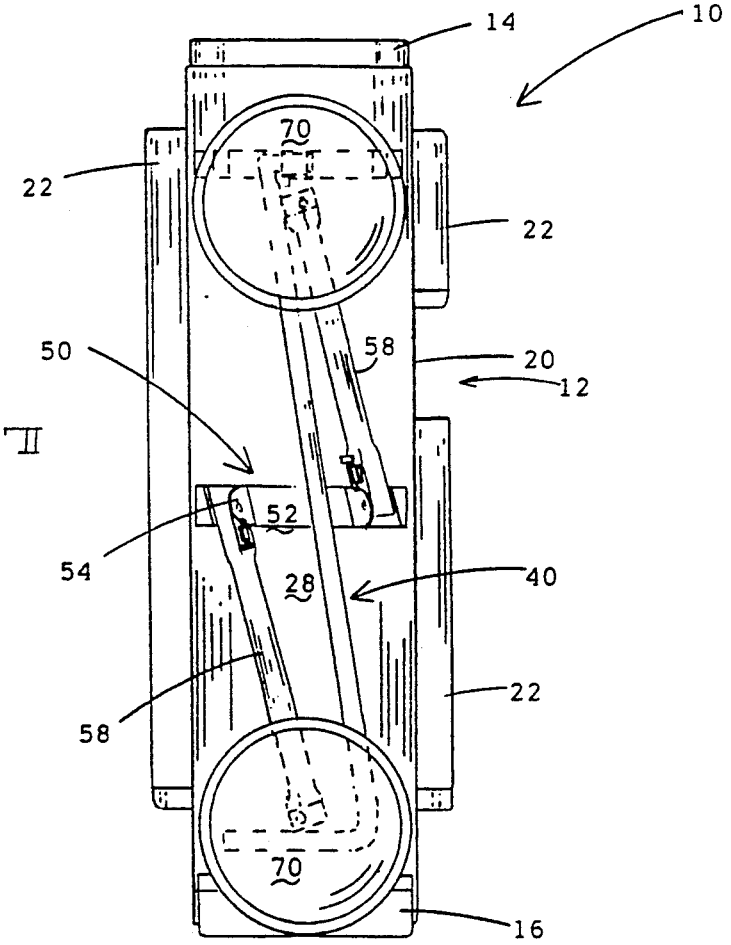
FIG. 7 is a plan view of the underside of the mobile cart showing the handle and ground wheels in the storage position.

The base (52) is designed to form two yokes (54) each of which support a shaft (56) that represents the axis upon which one end of each leg (58) is attached for pivoting. The walls of the yokes (54) are formed at angles which allow the legs (58) to be rotated from their collapsed position to their extended position. The yokes (54) are angled downwardly from the elongated wall (28) to which the (52) is attached. Furthermore, they are toed inward in opposite directions toward the imaginary center line of the elongated wall (28) which extends between the top and bottom elements (14 and 16) of the bag (12). The downward angle of the yoke walls allows the legs (58) to be extended out and away from the elongated wall (28) to which they are adjacent in their collapsed position, while the inward towing of the yokes (54) causes the end of each leg (58) to collapse onto the imaginary centerline between the top and bottom elements (14 and 16) as best shown in FIGS. 7 and 9.

Figure 15:
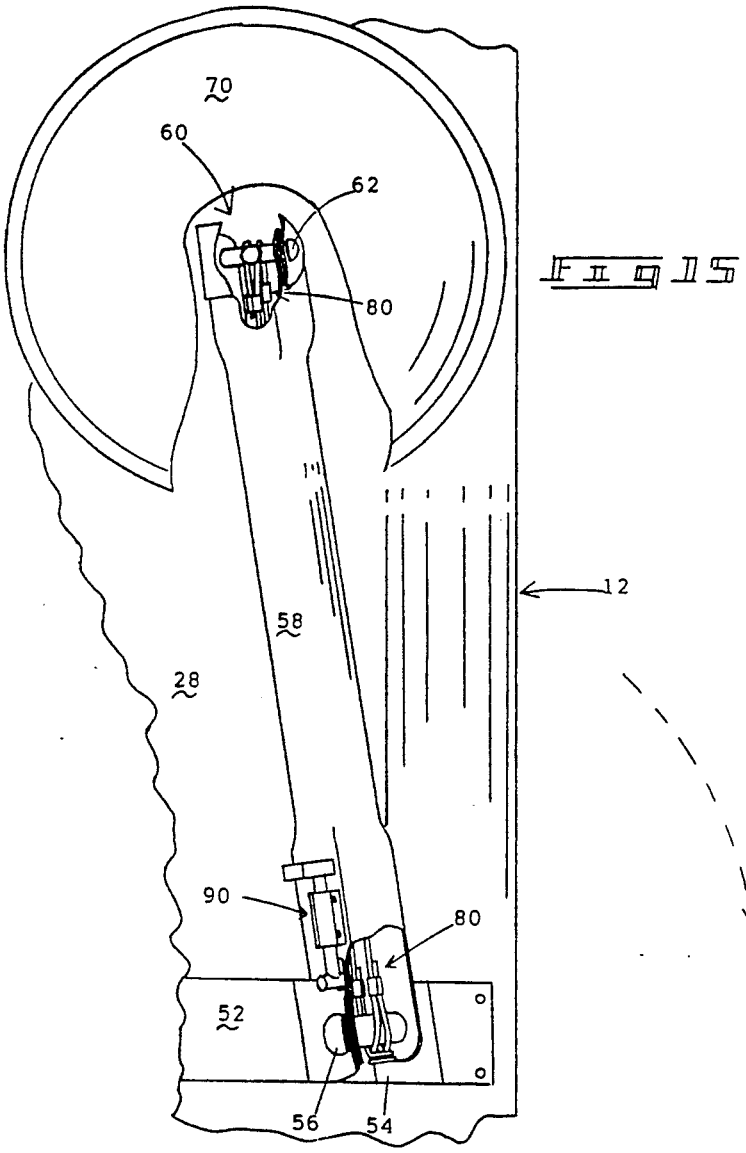
FIG. 15 is a view similar to FIG. 13 but showing end portions of the leg cut away to show the cable arrangement and orientation of the wheel axle assembly which is pivoted by the cable.
Figure 16:
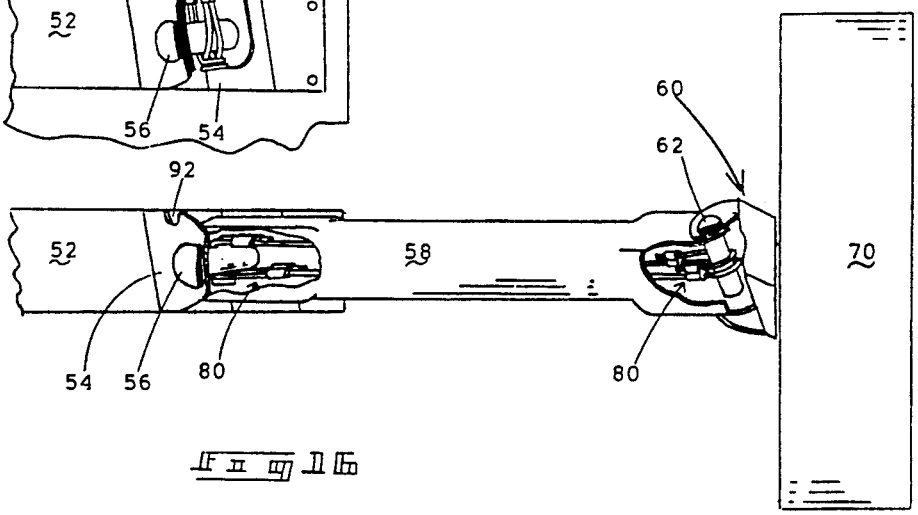
FIG. 16 is a view similar to FIG. 14 but showing end portions of the leg cut away.
Figure 17:
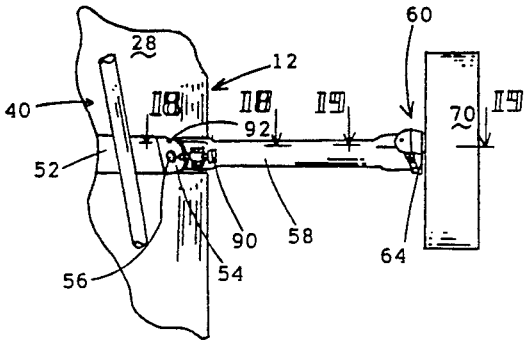
FIG. 17 is a view similar to FIG. 14 but illustrating that the handle is first moved to the retracted storage position before the wheel mechanism is moved to the storage position.
Figure 18:
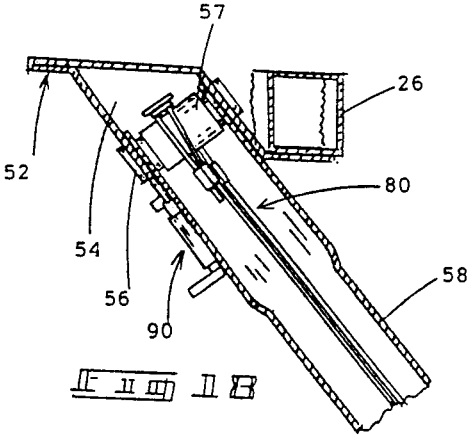
FIG. 18 is an enlarged sectional view of the upper portion of one leg of the wheel mechanism.
Figure 19:
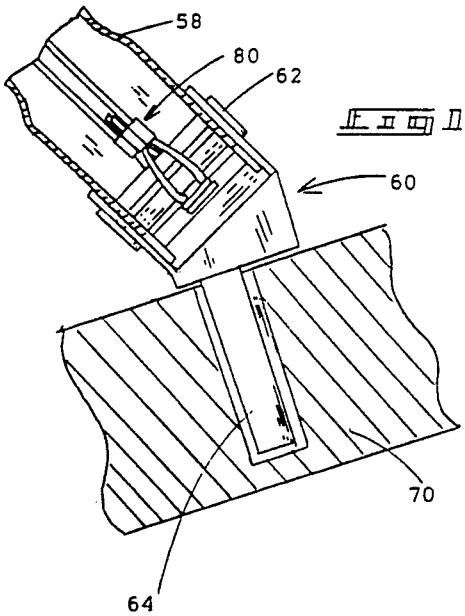
FIG. 19 is an enlarged sectional view of the lower portion of one leg of the wheel mechanism.

The leg (58) is a tubular piece with specially squared ends. The ends of the legs (58) are specially shaped on one end to match the walls of the yoke (54) so that the leg (58) is still free to rotate but is given extra support by the walls of the yoke (54) when the legs (58) are extended. The outer end of the leg (58) is specially shaped to cooperate with the wheel axle assembly (60). The special shape of the outer end of the leg (58) allows rotation of the wheel axle assembly (60) to occur within a limited range between the collapsed position (FIG. 15) and extended position (FIG. 16). The squared ends of each leg (58) are offset relative to each other (when viewed down the axis of the leg (58)) due to the special alignment required between the axis of the leg (58) and axis of the wheel axle assembly (60). This adjustment is required to cause the leg (58) and the attached wheel (70) to be moved from their collapsed positions to their extended positions.

The wheel axle assembly (60) is designed to fit over the free end of the leg (58) and is designed in cooperation with the shape of the end of the leg (58) to allow rotation from a defined collapsed position to a defined extended position. The wheel axle assembly (60) is connected to the end of the leg (58) via a shaft (62) which is extended through both the assembly (60) and leg (58). The wheel axle assembly (60) also is the base for the wheel axle (64) which is connected to this base at the appropriate angle relative to the axis of the wheel axle assembly (60). The wheel (70) is then connected to this axle (64) and is free to rotate.

The wheel axle assembly (60) is rotated into place via an internal cable (80) or strap drive system as the leg (58) is raised and lowered. The cable (80) is internal to the tubular leg (58) and runs around the exterior of the leg base shaft (56) and the wheel assembly shaft (62). The cable (80) is connected to each shaft (56 and 62) in order to cause rotation to occur. A specially shaped bearing (57) is placed over the leg base shaft (56) and the cable (80) is connected to the exterior of this bearing (57). The bearing (57) and the shaft (56) are locked into a non-rotational or fixed position in order to cause the wheel axle assembly shaft (62) to rotate as the leg (58) is rotated around the axis of shaft (56). The wheel axle assembly shaft (62) is locked into the wheel axle assembly (60) and thus as the shaft (62) pivots the entire axle assembly (60) pivots with respect to the outer end of the leg (58).

The mechanism accomplishes the objective of allowing one leg (58) and wheel (70) to be collapsed from an operating position angled out and away from the base member (52) inward and upward toward the open end of the golf club container (12) while the opposite leg (58) and wheel (70) are collapsed inward and downward toward the bottom or closed end of the golf club container (12). In the collapsed position, both legs (58) are adjacent to the elongated wall (28) and the wheeled end of each leg (58) meets the imaginary center line between the top and bottom elements (14 and 16) of the golf club container (12). Furthermore, as the legs (58) are rotated around the axis of the base shaft (56), the cable mechanisms (80) cause the wheels (70) to pivot from their extended operational positions to their collapsed positions parallel to and against opposite ends of the elongated wall (28) of the bag (12). Each leg (58) is locked into its two positions (extended/collapsed) via a spring loaded pin (90) attached to the leg (58) and aligned with notches (92) in the yoke (54) to lock the wheel mechanism (50) into plate.

Another embodiment shown in FIGS. 20 & 21 of the wheel mechanism (50) for the cart (10) accomplishes the objective of collapsing the wheel mechanism (50) in the aforementioned unique novel fashion utilizing an alternative means. This embodiment of the wheel mechanism (50) is comprised of a base assembly (152) Which for the purposes of this illustration is designed to be connected to the two elongated support tubes (26) of the aforementioned golf club container (12).

The base assembly (152) is comprised of a base plate (153) designed to be connected to the elongated tubes (26) of the bag (12). The surface of this base plane (153) is flat and parallel to the elongated wall (28) to which it is adjacent. Mounted on this base plate (153) is a secondary leg base (154). The secondary leg base (154) is mounted on the base plate (153) via a shaft (155). The shaft (155) is located on the imaginary center line of the elongated wall (28) which extends between the top and bottom elements (14 and 16) of the bag (12). The secondary leg base (154) is free to rotate within a limited range of 90 degrees. At the ends of this rotational range it is latched into position via a spring loaded latch (193). The two positions correspond to the collapsed and extended leg positions. The secondary leg base (154) forms two yokes (156) set in opposing directions from each other. Each of the yokes (156) supports a shaft (157) that represents the axis upon which one end of each leg (158) is attached for raising and lowering. The walls of the yokes (156) are perpendicular to the plane of the elongated wall (28) to which the base assembly (152) is attached. The yokes (156) permit the legs (158) to be moved downward away from the plane of the elongated wall (28) to which the base member (152) is attached.

The leg (158) is a squared tubular piece with specially curved ends. One end of each leg (158) is shaped to match the walls of the yoke (156) and is specially curved on the end to allow rotation within the yoke (156). The outer end of each leg is specially shaped to cooperate with the wheel axle assembly (160). The special shape of the outer end of the leg (158) allows rotation of the wheel axle assembly (160) to occur within a limited range between a collapsed and extended position. In this embodiment the ends of each leg (158) are parallel to each other allowing the leg shaft (157) and wheel axle assembly shaft (162) to be parallel to each other.

The wheel axle assembly (160) is designed to fit over the free end of the leg (158) and is designed in cooperation with the shape of the end of the leg (158) to allow rotation from a defined collapsed position to a defined extended position. The wheel axle assembly (160) is connected to the outer end of the leg (158) via a shaft (162) which is extended through both the assembly (160) and leg (158). The wheel axle assembly (160) is also the base for the wheel axle (163) which is connected to this base at an angle which is perpendicular to the wheel axle assembly shaft (162). The wheel (70) is then connected to this axle (163) and is free to rotate.

The wheel axle assembly (160) is rotated into place via an internal cable of strap drive system (180) as the leg (158) is moved up and down within the yoke (156). The cable (180) is internal to the tubular leg (158) and runs around the exterior of the leg base shaft (157) and the wheel axle assembly shaft (162). The cable (180) is connected to the leg shaft and wheel axle assembly shaft (157 and162) in order to cause rotation to occur. The leg axis (157) is locked into a non-rotational position to cause the wheel axle assembly shaft (162) to rotate as the leg (158) is rotated around the axis of the leg shaft (157). The wheel axle assembly shaft (162) is locked into the wheel axle assembly (160) and thus as the wheel axle assembly shaft (162) pivots the entire wheel axle assembly (160) rotates around the outer end of the leg (150).

This embodiment requires a two directional movement of the leg (158) to accomplish the objective of allowing one leg (158) and wheel (70) to be collapsed from an operating position angled out and away from the base assembly (152) inward and upward toward the open end of the golf club container (12) while the opposite leg (158) and wheel (70) are collapsed inward and downward toward the bottom closed end of the golf club container (12). To accomplish this each leg (158) is first moved upward within its yoke (156) until it meets the plane of the elongated wall (28) to which the base is attached. In this position, both legs (158) remain in a line perpendicular to the imaginary center line of the elongated wall (28) which extends between the top and bottom elements (14 and16) of the bag (12). The legs are held in this position and their extended position via a spring loaded latch (190). Once the legs (158) have been raised upward, the secondary leg base (154) is when rotated 90 degrees to a collapsed position. It is locked in this position via a spring loaded latch (190). In the collapsed position, both legs (158) are adjacent to the elongated wall (28) and meet the imaginary center line between the top and bottom elements (14 and 16) of the golf club container (12). Furthermore, the raising and lowering of the legs (158) within the yokes (156) causes the wheels (70) to be rotated from an extended to a collapsed position via the internal cable (180). The raising and lowering of the legs (158) rotates the wheels (70) from positions perpendicular to the plane of the elongated wall (28) to which the base assembly (152) is attached to positions parallel to the elongated wall (28).

Figure 22:
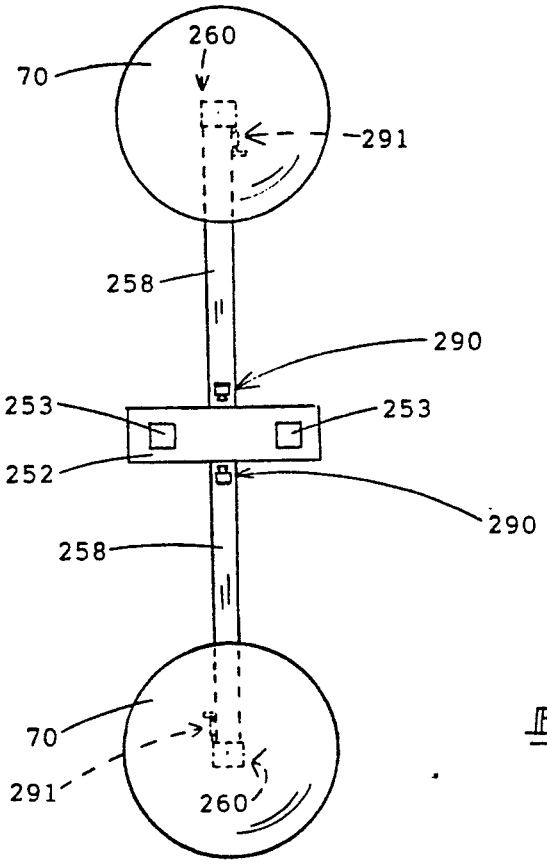
FIG. 22 is a bottom plan view of a second alternative embodiment of the wheel mechanism with the legs inserted in their retracted slots and the wheels in their retracted positions.
Figure 23:
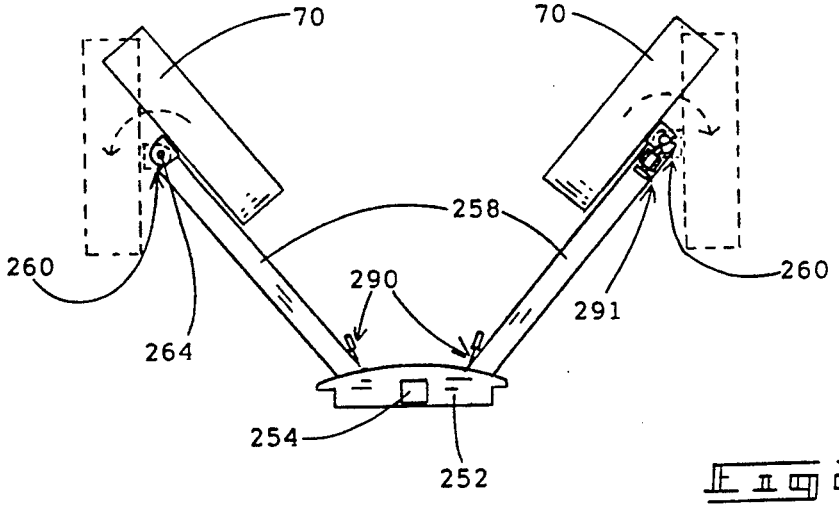
FIG. 23 is a front elevational view of the alternative embodiment of the wheel mechanism shown in FIG. 22 with the legs inserted into the extended operating slots and wherein the rotation of the wheels from their retracted to extended positions is illustrated in dashed lines.

A third more simplified embodiment shown in FIGS. 22 and 23 of the wheel mechanism (50) accomplishes the objective of collapsing the wheel mechanism (50) in the aforementioned unique novel fashion utilizing an alternative means. This embodiment of the wheel mechanism (50) is comprised of a base member (252) which for the purposes of this illustration is designed to be connected to the two elongated support tubes (26) of the aforementioned golf club container (12).

The base member (252) serves two purposes. One to connect the wheel mechanism (50) to the bag (12) and the other to provide support for the legs (258). With this embodiment, the base member (252) is designed with two squared collapsed slots (254) and two squared extended slots (253) representing female receiving ends to support one end of each leg (258) in the collapsed and extended leg positions. The squared collapsed slots (254) are directionally oriented parallel to and adjacent to the imaginary center line of the elongated wall (28) which extends between the top and bottom elements (14 and 16) of the bag (12) on opposing sides of the base member (252) with one opening toward the top of the bag (12) and the other opening toward the bottom of the bag (12). These collapsed slots (254) correspond to the collapsed leg positions. The other two squared extended slots (253) are directionally oriented downward and away form the imaginary center line of the elongated wall (28) which extends between the top and bottom elements (14 and 16) of the bag (12). Furthermore, the extended slots (253) open in opposing directions along an imaginary plane perpendicular to and bisecting the imaginary center line of the elongated wall (28) which extends between the top and bottom elements (14 and 16) of the bag The leg (258) is a squared tubular piece. One end of each leg (258) is shaped to match the walls of the squared extended and collapsed slots (253 and 254) of the base member (252). The outer end of each leg (258) is specially shaped to cooperate with the wheel axle assembly (260). The special shape of the outer end of the leg (258) allows rotation of the wheel axle assembly (260) to occur within a limited range between a collapsed and extended position.

The wheel axle assembly (260) is designed to fit over the free end of the leg (258) and is designed in cooperation with the shape of the end of the leg (258) to allow rotation from a defined collapsed position to a defined extended position. The wheel axle assembly (260) is connected to the outer end of the leg (258) via a shaft (264) which is extended through both the wheel axle assembly (260) and the leg (258). The wheel axle assembly (260) is also the base for the wheel axle (263) which is connected to this base at an angle which is perpendicular to the wheel axle assembly shaft (264). The wheel (70) is then connected to this axle (263) and is free to rotate.

This embodiment requires manually removing the legs (258) from the extended slots (253) and inserting them in the collapsed slots (254) in order to accomplish the objective of allowing one leg (258) and wheel (70) to be collapsed from an operating position angled out an away from the base member (252) inward and upward toward the open end of the golf club container (12) while the opposite leg (258) and wheel (70) are collapsed inward and downward toward the bottom or closed end of he golf club container (12). The legs are held in the extended and collapsed slots (253 and 254) via a spring operated latch mechanism (290). Furthermore, the removing and inserting of the legs (258) between extended and collapsed slots (253 and 254) requires the wheel axle assemblies (260) to be manually rotated around the end of the leg (258) from an extended to a collapsed position. The wheel (70) is rotated from a position perpendicular to the plane of the elongated wall (28) to which the base member (252) is attached when the leg (258) is extended to a position parallel to the elongated wall (28) when the leg (258) is collapsed. The wheel axle assembly (260) is locked into extended and retracted positions via a spring loaded pin mechanism (291).

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A wheel mechanism for a mobile cart having an elongated member with a longitudinal center axis, said wheel mechanism comprising:

(a) a pair of leg members operably attached at one end to the elongated member in a manner so that said leg members are pivotally movable with respect to the elongated member;

(b) a pair of ground wheels pivotally attached to the opposite ends of said leg member is evenly positioned on either side of a plane containing the axial center of said elongated member when in a transport position; and (c) means for pivoting each of the ground wheel about their pivotal attachment with their respective leg member in response to pivotal movement of such leg member, whereby the ground wheels move with respect to such leg member the transport position in which the wheel second out from the elongated member and are each oriented in individual planes disposed substantially parallel to said plane containing the elongated member center axis, and a storage position in which the wheels are disposed adjacent of the elongated member and are oriented in a common plane substantially perpendicular to the plane of the elongated member center axis.

2. A wheel mechanism as recited in claim 1, wherein said wheel pivoting means is associated with an extends between the pivotal connections of each leg member with its respective ground wheel and the elongated member.

3. A wheel mechanism as recited in claim 2 wherein said wheel pivoting means includes a shaft that is fixed with respect to said elongated member for operably connecting each leg member to said elongated member, a shaft that is rotatable with respect to each leg member for operably connecting each leg member to its respective wheel, and cable means that extends between and is connected to the fixed and rotating shafts.

4. A wheel mechanism as recited in claim 3 wherein pivotal movement of one of the leg members causes rotatable movement of its respective fixed shaft with respect to the cable means, which movement is transmitted by the cable means to its respective rotatable shaft to rotate and thereby move its associated wheel into a transport position.

5. A wheel mechanism as recited in claim 4 wherein the fixed shaft and the rotatable shaft have axes lying in offset planes.

6. A wheel mechanism as recited in claim 4 wherein each leg member is formed of tubular material and wherein said cable means includes a pair of cables disposed within each leg member, each of said cables having one end rigidly secured to the fixed shaft and an opposite end rigidly secured to the rotating shaft such that movement of the leg member causes one of the cables to be payed out from the fixed shaft while the other of the cables is taken upon the fixed shaft.

7. A wheel mechanism as recited in claim 6 and further including leg latching means for securing the leg members in one of the transport position or the storage position.

8. A wheel mechanism for a mobile cart having an elongated member with a longitudinal center axis , said wheel mechanism comprising:

(a) a pair of leg members operably attached at one end to the elongated member in a manner so that said leg members are pivotally movable with respect to the elongated member;

(b) a pair of ground wheels pivotally attached to the opposite ends of said leg members and evenly positioned on either side of a plane containing the axial center of said elongated member when in a transport position; and (c) means for pivoting each of the ground wheels about their pivotal attachment with their respective leg member in response to pivotal movement of such leg member, whereby the ground wheels move with respect to such leg member between the transport position in which the wheels extend out from the elongated member and are each oriented in individual planes disposed substantially parallel to said plane containing the elongated member center axis, and a storage position in which the wheels are disposed adjacent to the elongated member and are oriented in a common plane substantially perpendicular to the plane of the elongated member center axis.

9. A mobile cart as recited in claim 8 wherein said wheel pivoting means is associated with and extends between the pivotal connections of each leg member with its respective ground wheel and the elongated member.

10. A mobile cart as recited in claim 9 wherein said wheel pivoting means includes a shaft that is fixed with respect to said elongated member for operably connecting each leg member to said elongated member, a shaft that is rotatable with respect to each leg member for operably connecting each leg member to its respective wheel, and cable mans that extends between and is connected to the fixed and rotating shafts.

11. A mobile cart ar recited in claim 10 and further including a handle mechanism operably attached to the elongated member, and means for permitting the selective movement of the handle mechanism between an extended transport position and a retracted storage position.

12. A mobile cart as recited in claim 11 wherein in handle storage position the handle is disposed adjacent to the elongated member and the ground wheels when the ground wheels are also in the wheel storage position.

13. A mobile cart, comprising:

(a) container means for selectively receiving material to be transported, said container means including an elongated exterior wall;

(b) a pair of leg members operably attached at one end to the elongated wall in a manner so that said leg members are pivotally movable with respect to the elongated wall;

(c) a pair of ground wheels pivotally attached to the opposite ends of said leg members; and (d) means for pivoting each of the ground wheels about their pivotal attachment with their respective leg member in response to pivotal movement of such leg member, whereby the ground wheels move with respect to such leg member between a transport position in which the wheels extend out from the elongated wall and are each oriented in individual planes disposed substantially perpendicular to the plane of the elongated wall, and a storage position in which the wheels are disposed adjacent to the elongated wall and are oriented in a common plane substantially parallel to the plane of the elongated wall.

14. A mobile cart as recited in claim 13 wherein said wheel pivoting means is associated with and extends between the pivotal connections of each leg member with kits respective ground wheel an the elongated wall.

15. A mobile cart as recited in claim 14 wherein the container means includes an elongated concave cavity extending medially along the elongated wall, and wherein portions of the wheel pivoting mean are positioned in said cavity when the wheels are in the wheel storage position.

16. A mobile cart as recited in claim 15 and further including a handle mechanism operably attached to the elongated wall, and means for permitting the selective movement of the handle mechanism between an extended transport position and a retracted storage position.

17. A mobile cart as recited in claim 16 wherein portions of the handle mechanism are positioned in said cavity when the handle mechanism is in the handle storage position.

18. A mobile cart as recited in claim 13 wherein the bottom of said container means is angled from the edge of the elongated wall to a flat portion that forms a position of the bottom.

* * * * *